United States Patent [19]

Clarke, Jr. et al.

[11] Patent Number: 4,564,186

[45] Date of Patent: Jan. 14, 1986

[54] APPARATUS FOR GATHERING PRINTED SIGNATURES FOR SADDLE STITCHING

[75] Inventors: Frederick G. E. Clarke, Jr., Essex, Conn.; Anthony R. King, Bourbon; Anthony Majewski, Warsaw, both of Ind.

[73] Assignee: R. R. Donnelley & Sons Company, Chicago, Ill.

[21] Appl. No.: 617,904

[22] Filed: Jun. 4, 1984

[51] Int. Cl.[4] ..... B65H 39/02

[52] U.S. Cl. ..... 270/54; 271/150; 271/171; 198/644

[58] Field of Search ..... 37/53–54, 37/57–58; 271/94, 96, 149, 150, 171, 198, 144; 198/644

[56] References Cited

U.S. PATENT DOCUMENTS

| | | | |
|---|---|---|---|
| 3,519,264 | 7/1970 | Beacham et al. | 270/54 X |
| 3,565,422 | 2/1971 | McCain et al. . | |
| 3,617,048 | 11/1971 | Albert | 271/171 |
| 3,717,337 | 2/1973 | McCain et al. | 270/54 X |
| 3,806,111 | 4/1974 | Lachman et al. | 270/54 |
| 3,899,165 | 8/1975 | Abram et al. | 270/58 |
| 4,121,818 | 10/1978 | Riley et al. | 270/58 |
| 4,162,066 | 7/1979 | McCain et al. | 270/54 |
| 4,177,982 | 12/1979 | Bewersdorf et al. | 271/150 X |
| 4,241,907 | 12/1980 | McCain et al. | 270/54 |
| 4,436,469 | 3/1984 | Kelly | 271/171 |

*Primary Examiner*—E. H. Eickholt

*Attorney, Agent, or Firm*—Wood, Dalton, Phillips, Mason & Rowe

[57] ABSTRACT

An improved apparatus for gathering printed signatures for saddle stitching has a single frame having shafts that carry two complete mechanisms each of which includes signature supply box means and signature transfer means for feeding 1-up signatures to a conveyor chain. The apparatus can be produced by a relatively simple conversion of a commercially available 2-up machine.

10 Claims, 9 Drawing Figures

FIG. 7
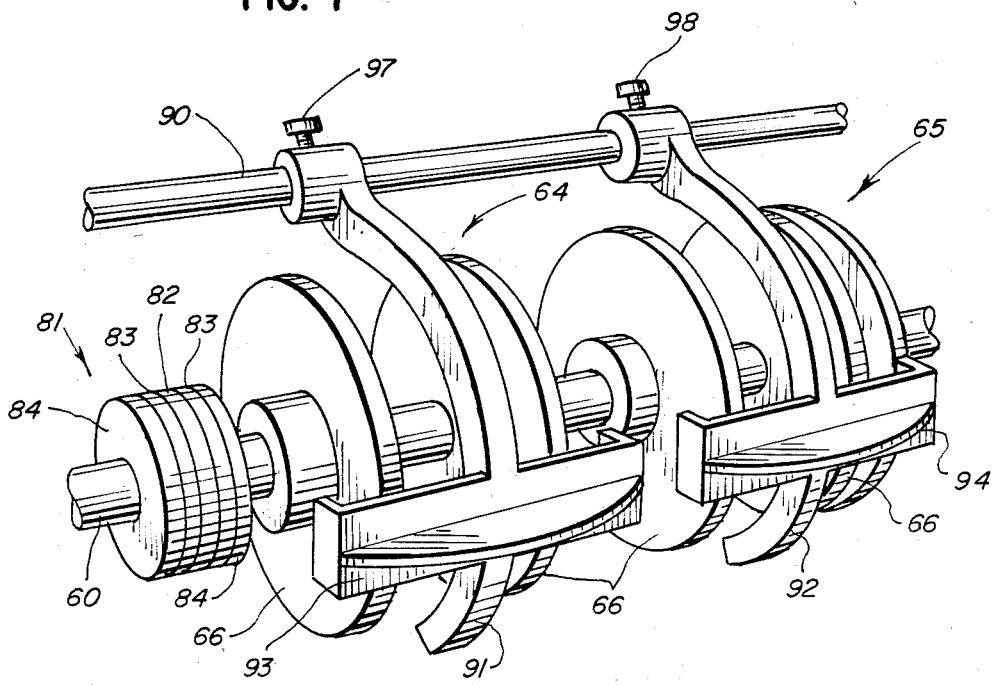
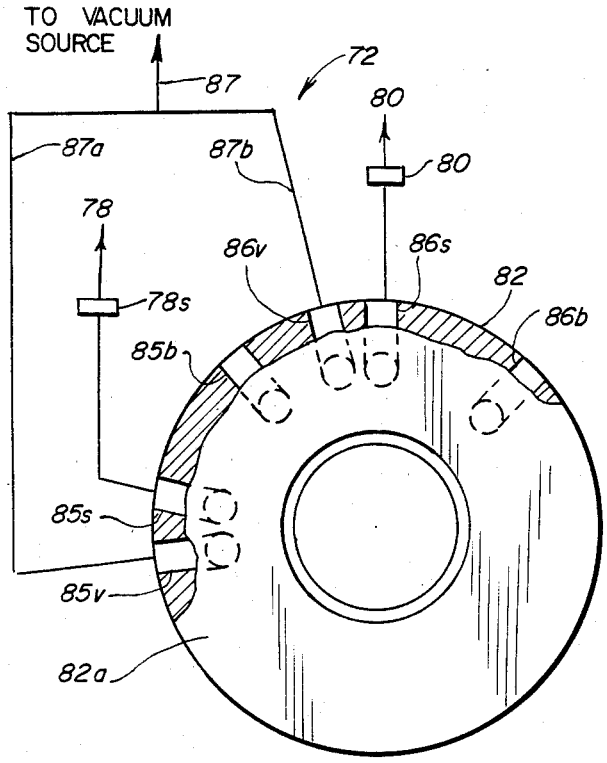
FIG. 8
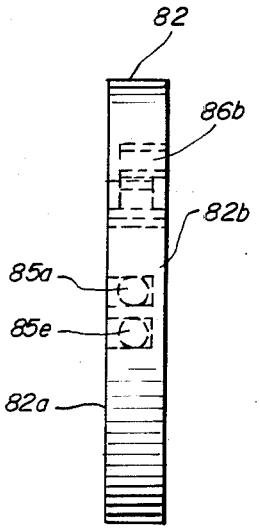
FIG. 9

APPARATUS FOR GATHERING PRINTED SIGNATURES FOR SADDLE STITCHING

FIELD OF THE INVENTION

This invention relates to improved apparatus for gathering printed signatures for saddle stitching; and, more particularly, it relates to a relatively compact and low-cost apparatus for handling 1-up signatures which may be built as a conversion of a commercially available 2-up machine.

BACKGROUND ART

The designations 1-up and 2-up have been used in the bindery industry to identify distinct operating modes. In the 1-up mode, printed signatures used to compose individual books are consecutively gathered, bound and trimmed serially along a bindery line.

Because high volume binding of books is a time critical operation, an interest in speed prompted the advent of the 2-up machine. The basic 2-up operation is similar to 1-up operation with the primary distinction that each 2-up signature usually consists of identically printed halves married along a common edge. After stitching, the 2-up signatures are divided to derive separate books. Because each operation in the bindery line is performed on two books simultaneously, the potential output rate is increased over 1-up operation.

The interest in overall system flexibility has in the past competed with the goal of high speed production. The flexibility potential in modern 1-up bindery systems is demonstrated in U.S. Pat. Nos. 3,899,165 (Abram et al) and 4,121,818 (Riley et al), both assigned to the assignee of this invention.

According to the systems in Abram et al and Riley et al, it is possible to individually tailor each book according to the special interests of a subscriber without time consuming and expensive line changes. Individual lines can be set to produce customized books for a specific destination with individual books potentially provided with special pages, inserts and/or customized ink jetting on selected signatures internally of the books. This eliminates otherwise burdensome and complicated sorting by postal zone required to comply with postal regulations and take advantage of attractive postal discounts; or permits easy bundling of books for the most efficient and economical non-postal delivery.

In both 1-up and 2-up systems, a single stroke of a reciprocative shuttle conveyor takes one unbound book from a gathering conveyor and presents the same at a stitching station. Upon completion of the stitching, the bound book is moved away from the stitching apparatus for trimming, etc. The system bottleneck normally occurs at the stitching station. The output speed for the line is dictated by the speed of the single book stitcher which has inherent mechanical speed limitations. High speed stitchers also represent a substantial expense.

To date, the goals of high speed production and system flexibility have been to a certain extent mutually exclusive. The use of the 2-up mode, which potentially doubles production rate, eliminates much of the system flexibility. The married pages of the 2-up signatures are usually identical. The books can be customized only in pairs in the 2-up mode.

Another major factor which makes 2-up printing and binding less desirable than 1-up for certain types of work is the press room cost of printing in the 2-up mode. For example, in the case of a 32 page four color catalog, in the 1-up mode the entire catalog can be run with a single set of eight cylinders upon a single press. This means, for example, that a run of 1 million catalogs can be produced in a single press run.

In the 2-up mode, on the other hand, the two pages which are printed at the same time must be duplicates of one another, so two press runs of 500,000 each are required to print the 32 pages. This substantially increases plate making and make-ready costs in the press room; although this is largely compensated for by the high output rate of the 2-up bindery line.

The mix of work being received in a plant having 2-up bindery lines may make it desirable to convert a commercially available 2-up line for 1-up operation so that the same equipment may be used either in the 2-up mode or the 1-up mode, or in certain instances in a mode which involves the feeding of both 1-up and 2-up signatures for a single job. Prior to the present invention this was not possible.

The present invention is specifically directed to overcoming the problems enumerated above in a novel and simple manner.

SUMMARY OF THE INVENTION

The present invention provides an improved saddle-type gathering machine having a lugged gathering conveyor chain for delivering unbound books consisting of gathered signatures to a saddle stitcher.

In accordance with the invention a supporting frame has parallel side beams which are in planes normal to the line of the chain, and structural members connecting the side beams. Mounted in the side beams are two parallel shafts which carry the conveyor chains for two signature supply box means with a substantial space between the two supply box means, a transversely adjustable side guide plate mounted adjacent each side beam, and a pair of transversely adjustable intermediate guide plates in the space between the two signature supply box means. Signature transfer means includes a plurality of parallel shafts mounted in the side beams between the signature supply box means and the gathering conveyor chain, two separate signature transfer drum means mounted on the plurality of parallel shafts, each operatively associated with one of the two signature supply box means, and separate sets of suction grippers for moving signatures seriatim from each signature supply box means to the associate transfer drum means. Means are provided for driving the plurality of shafts and the gathering conveyor chains in timed relationship with one another to deliver signatures from both transfer drum means to the gathering conveyor chain; and means are also provided for operating each of the sets of suction grippers independently of the other set to selectively move signatures from the respective associated signature supply box means to the respective associated transfer drum means for delivery to the gathering conveyor chain.

A single supporting frame for two signature supply box means which utilize one pair of parallel shafts mounted in the side beams, with only one set of parallel shafts for two sets of transfer drum means, affords a much more compact and inexpensive arrangement than can be achieved with a conventional 1-up gathering machine in which each signature supply box and transfer drum means is mounted in a separate supporting frame between parallel side beams. In addition to the compactness and relatively low cost achieved by elimination of duplicate parts, approximately half the timing problems of a conventional 1-up gathering machine are eliminated by having simultaneously operating pairs of signature feeding stations.

Other objects and advantages of the invention will be apparent from the following detailed description, the appended drawings and the claims.

The Drawings

FIG. 7 is a schematic front elevational depiction of the extracting cylinders and the adjustable support arms for the limit switch detector means of the two signature transfer means;

FIG. 8 is a schematic elevational view of the valve means for controlling the application of vacuum to the two sets of suction gripper means with vacuum lines and controls illustrated diagrammatically; and FIG. 9 is a side elevational view, partly in section, viewing FIG. 8 from the left.

DETAILED DESCRIPTION OF THE INVENTION

Figure 1:
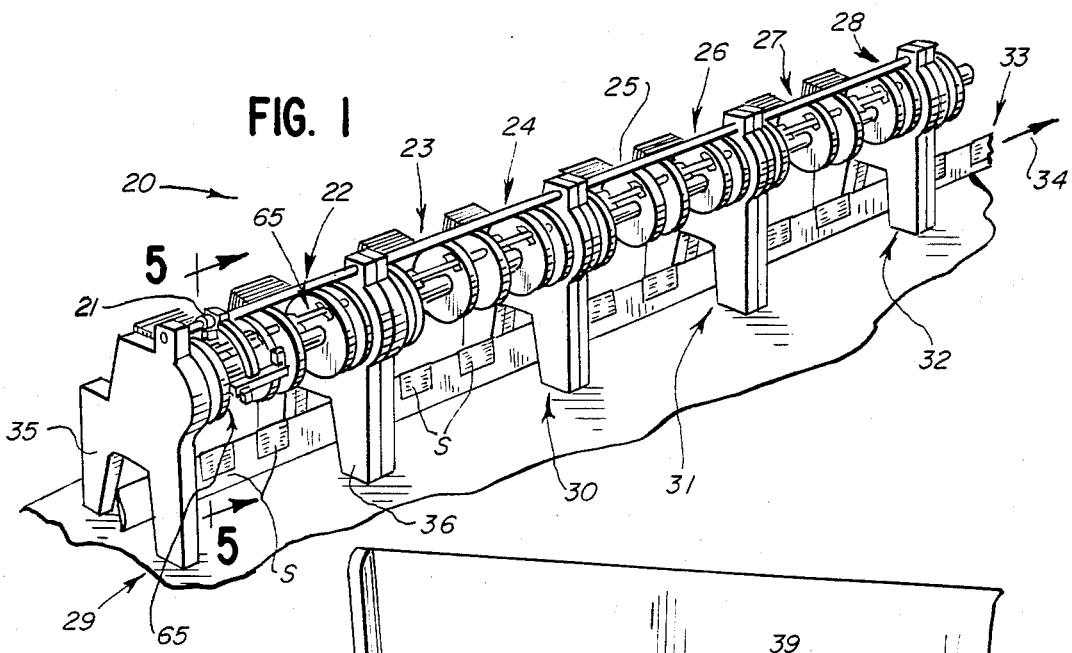
FIG. 1 is a fragmentary, partially schematic perspective view of a saddle-type gathering machine embodying the invention.

Referring to the drawings in detail, and referring first to FIG. 1, a saddle type gathering machine, indicated generally at 20, has a line of signature feeding stations, of which only eight stations, numbered 21 through 28, are illustrated in FIG. 1. The signature feeding stations are seen to be arranged in pairs 21-22, 23-24, 25-26, and 27-28, with each pair being carried in a supporting frame, and said supporting frames are indicated generally at 29, 30, 31 and 32. A lugged gathering conveyor chain 33 is driven in the direction of the arrow 34, and as the chain moves in front of the supply boxes it receives signatures S which are dropped by the signature transfer means to positions straddling the chain.

Since all the supporting frames 29–32 and the pairs of signature feeding stations 21–22, etc. are alike, only the supporting frame 29 and the signature feeding stations 21 and 22 are described in detail with reference to FIGS. 3–9.

The supporting frame 29 has parallel side beams 35 and 36 which are in planes normal to the line of the chain 33, and several structural members such as the members 37 and 38, connect the side beams. Toward the forward part of the supporting frame an upright front panel 39 is mounted upon brackets.

Figure 3:
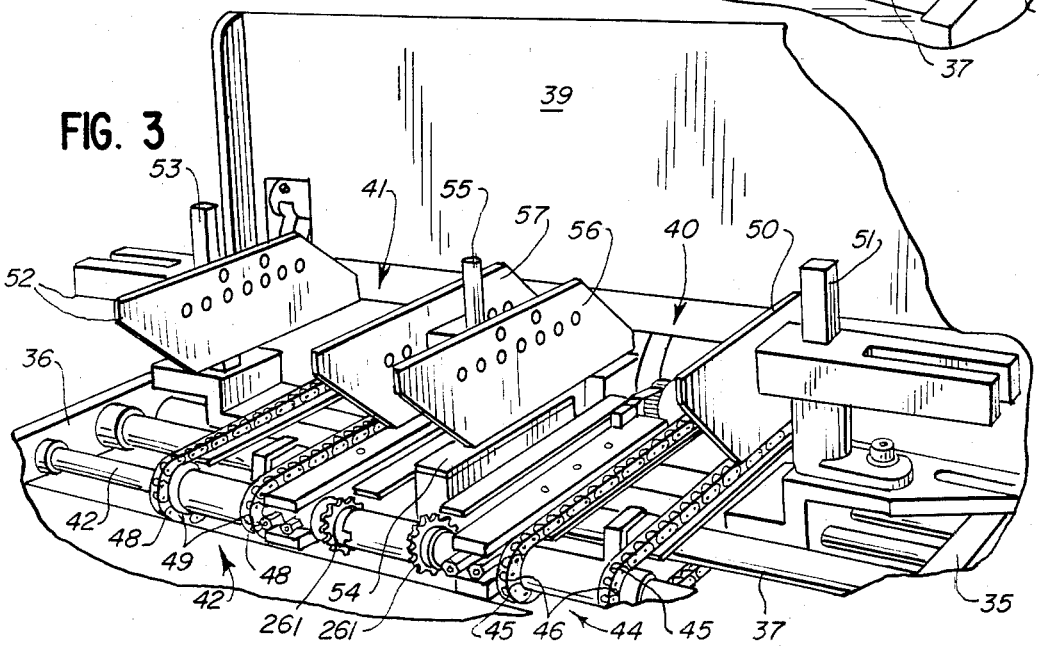
FIG. 3 is a view like FIG. 2 showing the two 1-up signature supply box means of the present invention which are derived by converting the apparatus of FIG. 2.
Figure 4:
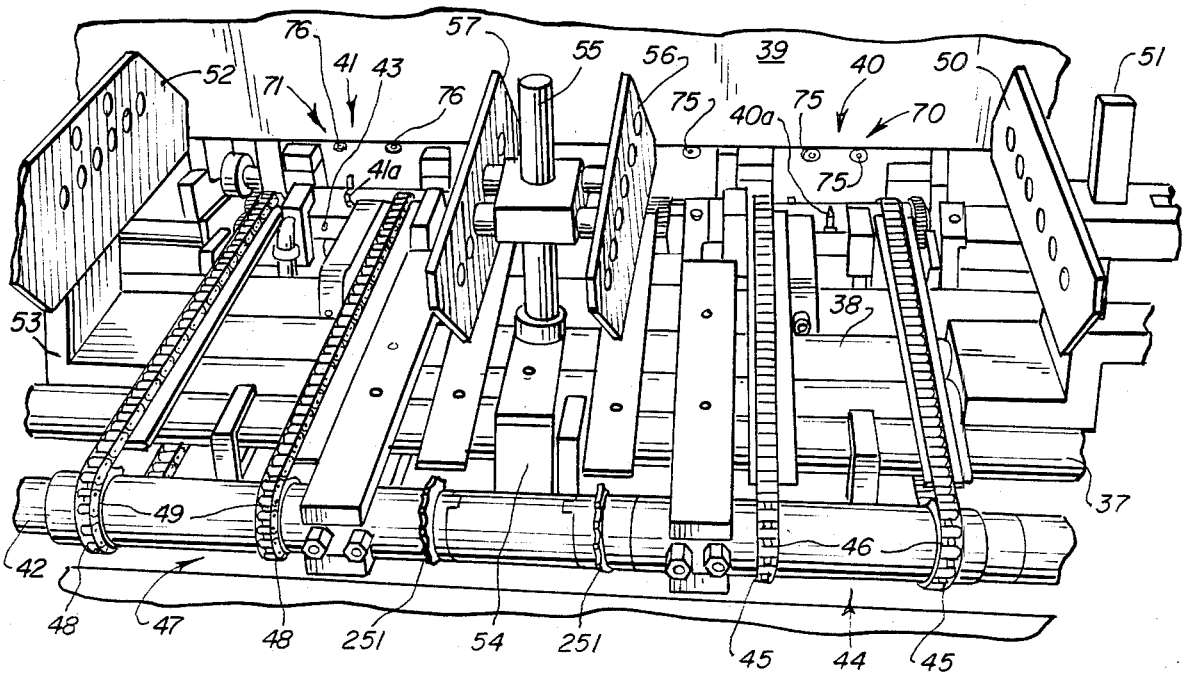
FIG. 4 is a perspective view of the two signature supply boxes of the invention looking straight toward the front.

In the rearward part of the frame, seen in FIGS. 3 and 4, are first and second signature supply box means, indicated generally at 40 and 41, respectively. Two parallel shafts, namely a rearward shaft 42 and a forward shaft 43, are mounted in the side beams 35 and 36 so as to extend entirely across the first and second signature supply box means 40 and 41. A first set 44 of parallel feed bands in the form of chains 45 in the first signature supply box means 40 is trained around sprocket wheels 46 journalled on the rearward shaft 42 and around sprockets (not shown) on the forward shaft 43. In the second signature supply box means 41 a second set 47 of parallel feed chains 48 is trained around sprockets 49 journalled on the rearward shaft 42 and around sprockets (not shown) on the forward shaft 43. Each of the sets 44 and 47 of parallel feed chains is positioned to support and feed a supply of signatures forwardly toward the lugged conveyor chain 33.

Each conveyor chain of the sets 44 and 47 is driven by a ratchet and pawl mechanism, which are not shown because they are conventional; and at the front of the signature supply boxes are respective governor pins **40*a* and 41*a*** which permit engagement of a pawl with a ratchet only when there is no signature at the front of the supply box. This, too, is standard mechanism.

A first transversely adjustable side guide plate 50 is mounted upon a bracket 51 that is carried on the supporting frame 29 adjacent the side beam 35, and an identical transversely adjustable side guide plate 52 is supported by a bracket 53 on the supporting frame 29 adjacent the side beam 36. In a substantial space between the first signature supply box 40 and the second signature supply box 41 is a mounting block 54 provided with a bracket 55 which supports a pair of transversely adjustable intermediate side guide plates 56 and 57 which cooperate, respectively, with the outside guide plates 50 and 52 to define adjustable sides of the respective signature supply boxes 40 and 41.

As is well known in the art, the entire line of feeding stations 21–28, and the lugged chain 33, are driven from a single power source through conventional power trains, parts of which are generally described hereinafter.

Figure 2:
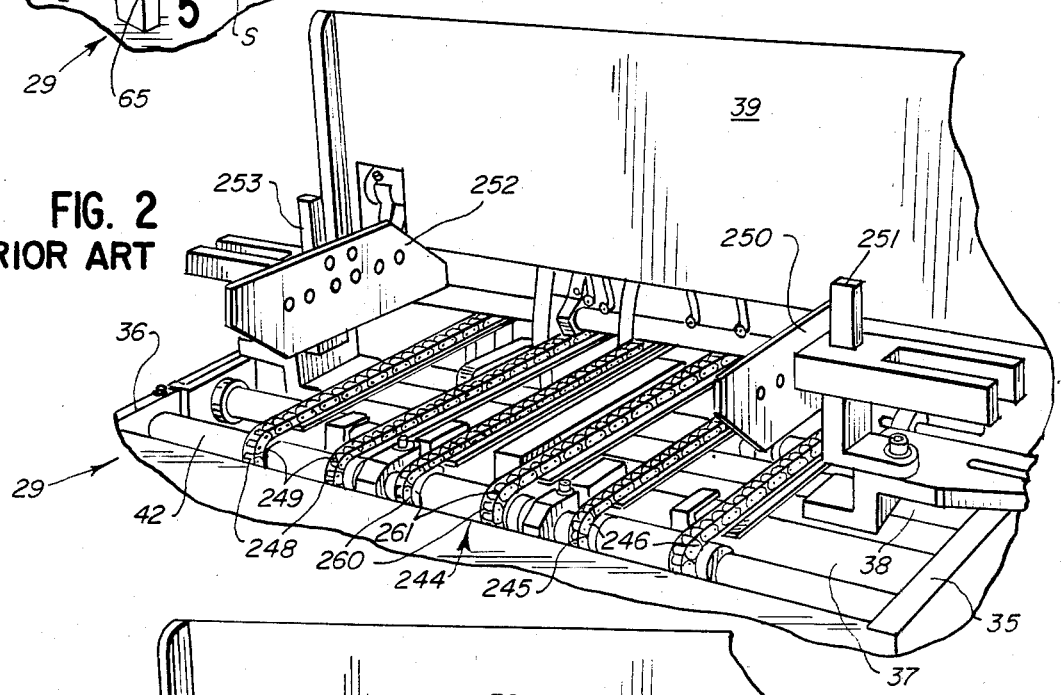
FIG. 2 PRIOR ART
FIG. 2 is a fragmentary perspective view of the signature supply box of a prior art 2-up gathering machine of a type which may be converted to provide the 1-up gathering machine of the present invention, viewed from the rear—i.e., looking toward the gathering conveyor chain.

Turning now to FIG. 2 which shows a prior art 2-up signature supply box, it is seen that in the prior art there is a single set 244 consisting of right side feed chains 245 trained around sprockets 246, left side feed chains 248 trained around sprockets 249, and intermediate feed chains 260 trained around sprockets 261.

Transversely adjustable side guides 250 and 252 are carried upon respective brackets 251 and 253 by means of which they are carried upon the supporting frame 29.

The intermediate sprockets 261 are also illustrated in FIG. 3, from which it becomes apparent that the conversion of the 2-up signature supply box of FIG. 2 to the dual 1-up signature supply box of FIG. 3 is accomplished by removing the intermediate signature feed chains 260 and putting in the new intermediate side guides 56 and 57 on their supporting bracket 55. Further, the sprockets and the feed chains of the sets 44 and 47 are relocated.

Figure 5:
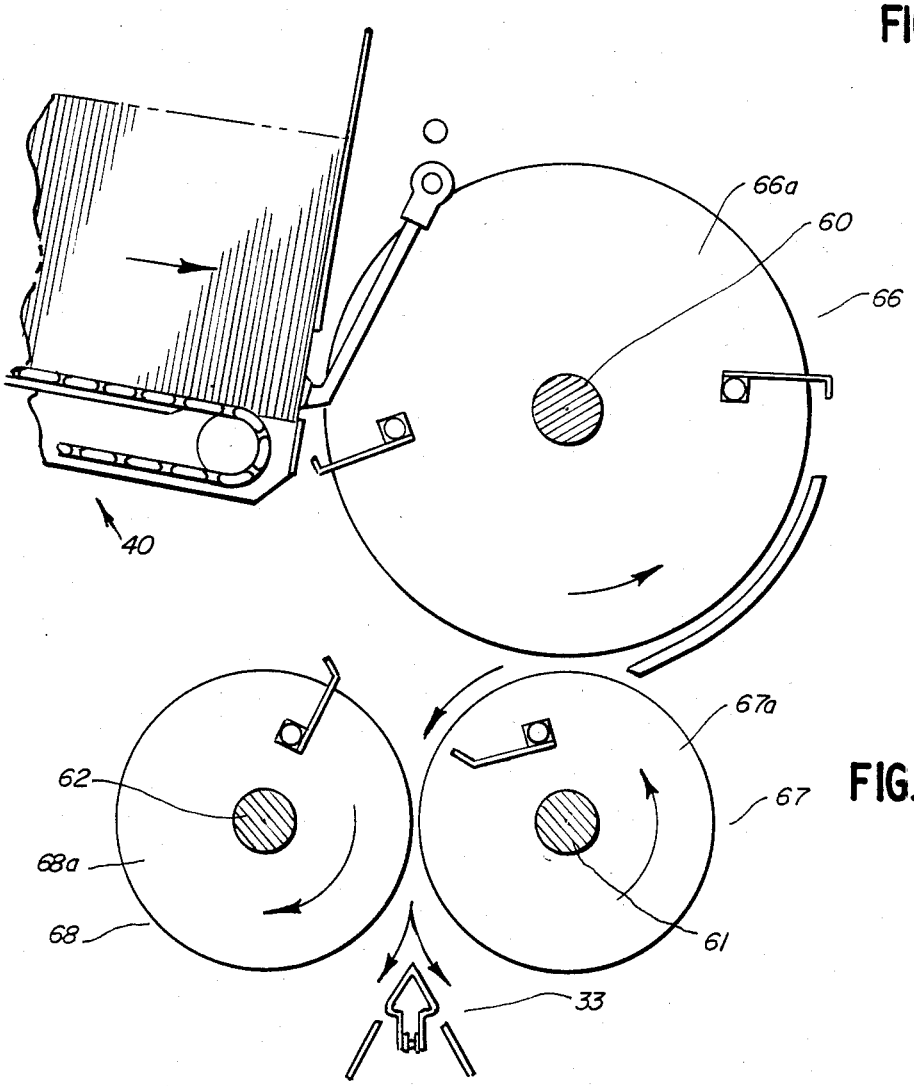
FIG. 5 is a schematic depiction of the signature transfer means for one of the two signature supply box means.
Figure 6:
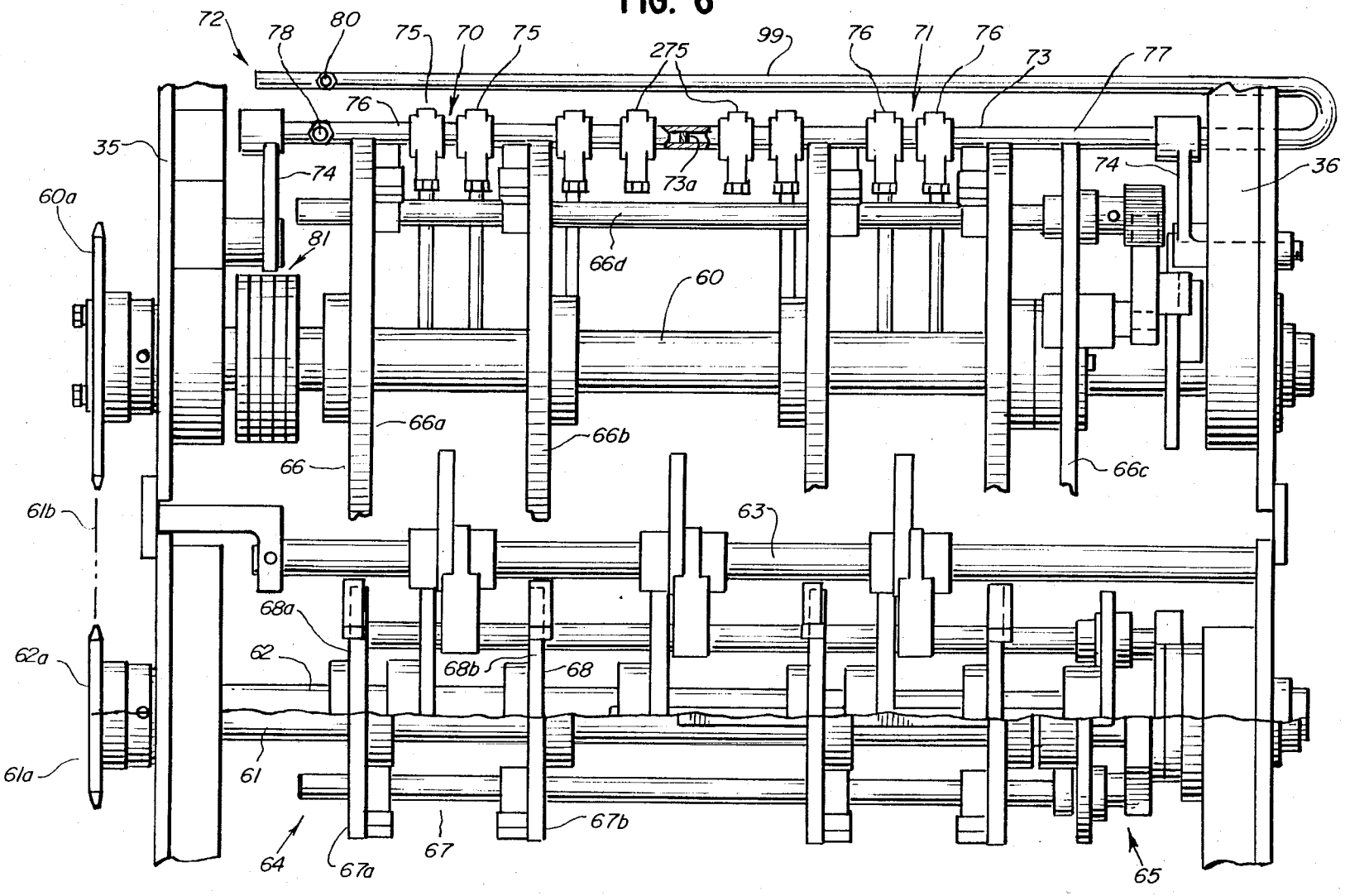
FIG. 6 is a fragmentary schematic front elevational depiction, partially in section, showing the signature transfer means including the operating and control means for the two sets of suction grippers.

Turning now to FIGS. 5–7, a plurality of parallel shafts 60, 61 and 62 are mounted in the side beams 35 and 36 between the signature supply box means 40 and 41 and the gathering conveyor chain 33. The parallel shafts 60–62 are parts of signature transfer means which include a first signature transfer drum means, indicated generally at 64 in FIGS. 1 and 5 to 7, and a second signature transfer drum means, indicated generally at 65 in FIGS. 1, 6 and 7. The two signature transfer drum means 64 and 65 are identical, so only the means 64 illustrated in FIG. 5 has its various major parts identified. Only the major parts are identified because the structure and function of each of the two signature transfer drum means 64 and 65 is well known to those skilled in the art, and is fundamentally the same as that of the 2-up apparatus before conversion.

Referring now particularly to FIGS. 5 and 6, the signature transfer drum means 64 and 65 each includes an extracting cylinder 66 mounted upon the shaft 60, a lap cylinder 67 mounted upon the shaft 61, and an opening cylinder 68 mounted upon the shaft 62. As seen in FIG. 6, the extracting cylinder 66 consists of two discs 66*a* and 66*b*, the lap cylinder 67 consists of two discs 67*a* and 67*b*, and the opening cylinder 68 consists of two discs 68*a* and 68*b*.

The only parts of the drive means illustrated in the drawings are a drive sprocket 60*a* on the shaft 60, a drive sprocket 61*a* on the shaft 61 and a drive sprocket 62*a* on the shaft 62, so that the shafts 61 and 62 are driven by a chain 61*b* from the sprocket 60*a*; and the shaft 60, in turn, is connected to the drive means by another sprocket and chain which are not illustrated. Each of the supporting frames 29–32 is provided with shafts 60, 61 and 62, and the drive means extends the entire length of the machine and has a chain drive to each of the shafts 60.

The signature transfer means also includes first and second sets of suction grippers, indicated generally at 70 and 71, respectively, in FIGS. 4 and 6. Said first and second sets of suction grippers are operatively associated, respectively, with the first signature supply box means 40 and transfer drum means 64, and with the second signature supply box means 41 and transfer drum means 65. Operating means, indicated generally at 72, serves to operate the two sets of suction grippers independently of one another to selectively move signatures from the respective associated signature supply box means 40 or 41 to the respective associated signature transfer drum means 64 or 65.

The two sets of suction grippers 70 and 71 are both supported upon a vacuum pipe 73 which is mounted upon pivoted arms 74 so the suction grippers 75*a* of the first set and 75*b* of the second set may oscillate to move signatures seriatim from a supply box means to the associated extracting cylinder 66. The oscillation of the suction grippers is also produced by a mechanism that is well known in the art, and that is used in the 2-up machine before conversion to 1-up.

The vacuum pipe 73 is divided by an isolating plug 73*a* into a first section 76 which carries the first set 70 of suction grippers, and a second section 77 which carries the second set 71 of suction grippers. Operatively connected to the first section 76 of the vacuum pipe is a connecting conduit 78, and operatively connected to the second section 77 is an adapter pipe 79 with a connecting conduit 80. The conduits 78 and 80 are provided with respective solenoid valves 78*s* and 80*s*, and connect the two sections 76 and 77 of the vacuum pipe to a vacuum source (not shown) through a valve means 81 which controls the application of vacuum from the vacuum source to each of the connecting conduits 78 and 80, but subject to individual override by the solenoid valves 78*s* and 80*s*. The valve means is, in effect, two separate valve structures, one of which controls the application of vacuum to the connecting conduit 78 and the other of which controls the application of vacuum to the connecting conduit 80.

The valve means 81 is of the common disc type illustrated in FIGS. 3 to 7 of U.S. Pat. No. 4,162,066; but without the "run" and "jog" modes of that patent. The valve means consists of a stationary porting center plate 82 which is flanked by two driven rotary fiber transfer discs 83 that are sandwiched between end plates 84. The porting plate 82 is seen in FIGS. 8 and 9 to have passages 85*v*, 85*s* and 85*b* in its circumferential surface which connect to one face 82*a* of the porting plate 82, and passages 86*v*, 86*s* and 86*b* which connect to the other face 82*b* of said plate. The passages 85*v* and 86*v* are connected through respective conduits 87*a* and 87*b* to a vacuum line 87. The passages 85*s* and 86*s* are connected, respectively, to the solenoid valves 78*s* and 80*s*. The passages 85*b* and 86*b* are bleed ports. As is described in U.S Pat. No. 4,162,066, the rotatable transfer discs 83 are provided with circumferential slots so that rotation of the discs places the connecting conduits 78 and 80 cyclically in communication with the respective vacuum passages 85*v* and 86*v*, and with the respective bleed ports 85*b* and 86*b*, so the suckers pick up and release signatures as required for machine operation. The unconverted 2-up machine has a plate corresponding to the plate 82 that has only one set of passages 85 or 86, and only one rotary fiber transfer disc corresponding to one of the discs 83.

It is also well known in the art to disable the suckers in accordance with a predetermined program for the purpose of selectively feeding signatures from less than all the boxes in a gathering machine line, so as to produce a publication that has some pages which are alike and some pages which differ from one another. This is accomplished in the present apparatus by the solenoid valves 78*s* and 80*s* that selectively isolate the connecting conduits 78 and 80 from the valve means 81. No further description on this mechanism is believed to be necessary because it is well known in the art and is not a part of the present invention but is used with the apparatus of the invention as it is with other gathering and binding machines.

Further major steps in the conversion of a 2-up gatherer to the 1-up mode of operation are described with reference to FIG. 6.

In the first place, the 2-up apparatus has an extracting cylinder consisting of five discs like the discs 66*a* and 66*b* of FIG. 6. One disc is removed and the other four discs are repositioned to be properly aligned with signatures delivered from the respective supply box means 40 and 41. This necessitates relocation of an extracting drum gripper operating cam 66*c* which also requires that a gripper operating shaft 66*d* be lengthened. Comparable changes are required for the lap cylinder 67 and the opening cylinder 68.

In a 2-up gatherer a vacuum pipe like the pipe 73 has no isolating plug 73*a*, so all the suction grippers operate simultaneously, and furthermore there are two extra suction grippers 275 which are plugged for the conversion to the 1-up mode of operation. Further, in the 2-up mode the right hand end of the vacuum pipe, as seen in FIG. 6, is closed; and in the conversion to the 1-up mode that end of the vacuum pipe is opened and the adapter pipe 79 and connecting conduit 80 are added. A single valve means for controlling vacuum connection to the suction grippers in the 2-up mode is replaced by the dual valve means 81 illustrated in FIG. 6.

Referring now particularly to FIG. 7, the structural members of the supporting frame include a round mounting rod 90 above the plurality of parallel shafts 60, 61 and 62. Pivotally and slidably mounted upon the round mounting rod 90 in operative association with the signature transfer drum means 64 is a first arcuate support arm 91; and a second arcuate support arm 92 is similarly mounted on the mounting rod 90 in operative association with the second signature transfer drum means 65. The respective support arms 91 and 92 are provided at their free ends with respective bracket means 93 and 94 for mounting limit switch detector means, for detecting malfunctions of the transfer drum means. The support arms 91 and 92 are provided with respective lockable adjusting means 97 and 98 which permit variations in the positions of the support arms both longitudinally and circumferentially of the round mounting rod 90.

In the 2-up apparatus, there is a round mounting rod 90, but it carries only a single arcuate mounting arm carrying the necessary three limit switch detector means for the 2-up apparatus.

The foregoing detailed description is given for clearness of understanding only and no unnecessary limitations should be understood therefrom, as modifications will be obvious to those skilled in the art.

We claim:

1. In a saddle type gathering machine having a lugged gathering conveyor chain for delivering unbound books consisting of gathered signatures to a saddle stitcher, in combination:

a supporting frame having parallel side beams which are in planes normal to the line of the chain, and structural members connecting said side beams;

first and second signature supply box means positioned side-by-side between and supported by said side beams, both said supply box means having forward ends toward the gathering conveyor chain;

signature transfer means including a plurality of parallel shafts mounted in said side beams between the first and second signature supply box means and the gathering conveyor chain and extending across the forward ends of both said supply box means, first signature transfer drum means carried on said plurality of shafts in operative association with said first signature supply box means, second signature transfer drum means carried on said plurality of shafts in operative association with said second signature supply box means, a first set of suction grippers for moving signatures seriatim from the first signature supply box means to the first transfer drum means, and a second set of suction grippers independent of said first set for moving signatures seriatim from said second signature supply box means to said second transfer drum means;

means for driving said plurality of shafts and said gathering conveyor chain in timed relationship with one another to deliver signatures from both transfer drum means to the gathering conveyor chain; and means for operating each of said first and second sets of suction grippers independently of the other set to selectively move signatures from the respective associated signature supply box means to the respective associated transfer drum means for delivery to the gathering conveyor chain.

2. The combination of claim 1 in which the first and second signature supply box means includes two parallel shafts mounted in the side beams, each of said supply box means has a set of parallel endless feed bands entrained around wheels on said shafts, said parallel feed bands being positioned to support and feed a supply of signatures, and there is a substantial space between the first and second signature supply box means, a transversely adjustable side guide plate is mounted adjacent each side beam, and a pair of transversely adjustable intermediate guide plates is mounted in the space between said first and second signature supply box means.

3. The combination of claim 2 in which the endless feed bands are chains and the wheels are sprockets.

4. The combination of claim 2 in which the means for operating each set of suction gripper means includes a vacuum pipe which extends across the supporting frame generally parallel to the gathering conveyor chain, isolating means dividing said vacuum pipe into first and second sections, a first array of suction lines in said first section operatively connected to the suction grippers of the first set, a second array of suction lines in said second section operatively connected to the suction grippers of the second set, a connecting conduit from each section of the vacuum pipe to a vacuum source, and valve means for selectively independently controlling the application of vacuum from said source to each of said connecting conduits.

5. The combination of claim 4 in which the structural members of the supporting frame include a round mounting rod above the plurality of parallel shafts, first and second arcuate support arms are pivotally mounted on said round mounting rod, each of said support arms being operatively associated with a corresponding one of the signature transfer drum means, means on each support arm for mounting limit switch detector means for detecting malfunctions of the transfer drum means, and a lockable adjusting means for each support arm to permit variations in the position of the support arm both longitudinally and circumferentially of the round mounting rod.

6. The combination of claim 1 in which there is a substantial space between the first and second signature supply box means, a transversely adjustable side guide plate is mounted adjacent each side beam, and a pair of transversely adjustable intermediate guide plates is mounted in the space between said first and second signature supply box means.

7. The combination of claim 1 in which the means for operating each set of suction gripper means includes a vacuum pipe which extends across the supporting frame generally parallel to the gathering conveyor chain, isolating means dividing said vacuum pipe into first and second sections, a first array of suction lines in said first section operatively connected to the suction grippers of the first set, a second array of suction lines in said second section operatively connected to the suction grippers of the second set, a connecting conduit from each section of the vacuum pipe to a vacuum source, and valve means for selectively independently controlling the application of vacuum from said source to each of said connecting conduits.

8. The combination of claim 1 in which the structural members of the supporting frame include a round mounting rod above the plurality of parallel shafts, first and second arcuate support arms are pivotally mounted on said round mounting rod, each of said support arms being operatively associated with a corresponding one

United States Patent [19]

Costa et al.

[11] Patent Number: 4,564,187

[45] Date of Patent: Jan. 14, 1986

[54] SHEET FEED DEVICE FOR A PRINTER OR TYPEWRITER

[75] Inventors: Jorge Costa; Wolfgang Reichel, both of Yverdon, Switzerland

[73] Assignee: Hermes Precisa International S.A., Yverdon, Switzerland

[21] Appl. No.: 616,149

[22] Filed: Jun. 1, 1984

[30] Foreign Application Priority Data

Jun. 3, 1983 [CH] Switzerland ..... 3056/83

[51] Int. Cl.[4] ..... B65H 1/28; B65H 5/26

[52] U.S. Cl. ..... 271/9; 271/118; 271/246; 271/114; 400/624; 400/605; 400/636.2; 400/649

[58] Field of Search ..... 271/9, 10, 4, 114, 116, 271/118, 245, 246; 400/605, 624, 625, 630, 631, 608.2, 636.2, 608.4, 649

[56] References Cited

U.S. PATENT DOCUMENTS 4,084,805 4/1978 Simpson ..... 271/4

4,222,557 9/1980 Wu ..... 400/625

4,475,731 10/1984 Wood ..... 271/9

*Primary Examiner*—Bruce H. Stoner, Jr.

*Assistant Examiner*—James E. Barlow

*Attorney, Agent, or Firm*—Emory L. Groff, Jr.

[57] ABSTRACT

The sheet feed device (1) comprises several cassettes (13) on which the sheets (11) are stacked, a removal mechanism, associated with each of the supports, intended to remove a sheet from the cassette (13) and introduce it into the printer (2), and a selection mechanism intended to activate one of the removal mechanisms. This selection mechanism consists of a guide part (72) comprising several tracks (73 to 75) and a selection lever (56) made to engage with the top of guide part (72). When the platen (3) of the printer (2) turns in the direction opposite the direction of introduction of the paper, the selection lever (56) is driven in the same direction. After a rotation of a predetermined angle, greater than two turns of the platen, the direction of rotation is reversed. The lever (56) follows one of the tracks (73 to 75) to activate one of the removal control parts (76 to 78) and to start the removal and introduction process. This arrangement makes possible, on the one hand, an uncomplicated drive control comprising only a single reversal of the drive direction and, on the other hand, the possibility of rolling back the platen (3) to correct or complete a previously printed line, without thereby starting a new selection and removal cycle.

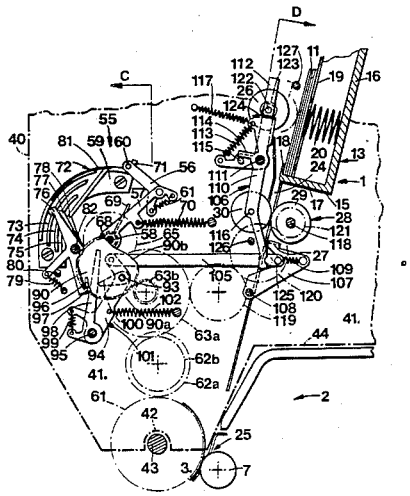

9 Claims, 4 Drawing Figures